United States Patent [19]

Miyamori et al.

[11] 4,389,387

[45] * Jun. 21, 1983

[54] METHOD FOR PREPARING CARBON FIBERS

[75] Inventors: Tamotsu Miyamori; Hisatsugu Kaji; Iwao Kameyama, all of Iwaki; Michio Takahashi, Tokyo, all of Japan

[73] Assignee: Kureha Kagaku Kogyo Kabushiki Kaisha, Tokyo, Japan

[ * ] Notice: The portion of the term of this patent subsequent to Feb. 9, 1999, has been disclaimed.

[21] Appl. No.: 303,624

[22] Filed: Sep. 18, 1981

Related U.S. Application Data

[63] Continuation-in-part of Ser. No. 105,130, Dec. 19, 1979, Pat. No. 4,314,981.

[51] Int. Cl.³ ..... C01B 31/07

[52] U.S. Cl. ..... 423/447.7; 264/29.2

[58] Field of Search ..... 264/29.2; 423/447.7, 423/447.8

[56] References Cited

U.S. PATENT DOCUMENTS

| | | | |
|---|---|---|---|
| 4,014,725 | 3/1977 | Schulz | 156/148 |
| 4,032,607 | 6/1977 | Schulz | 264/29.3 |
| 4,314,981 | 2/1982 | Miyamori et al. | 264/29.2 |

FOREIGN PATENT DOCUMENTS

| | | | |
|---|---|---|---|
| 911660 | 10/1972 | Canada | 8/93 |
| 1416614 | 12/1975 | United Kingdom . | |
| 1479218 | 7/1977 | United Kingdom . | |

*Primary Examiner*—Jay H. Woo

*Attorney, Agent, or Firm*—Wegner & Bretschneider

[57] ABSTRACT

The present invention relates to a method for preparing carbon fibers from a pitch by melt-spinning the pitch, infusibilizing the pitch fibers with a mixture of air and a gaseous oxidizing agent in an infusibilizing furnace divided into at least two chambers arranged in series under the condition of a velocity of the circulation gas in a specified range and then carbonizing the thus treated pitch fibers into carbon fibers.

5 Claims, 2 Drawing Figures

METHOD FOR PREPARING CARBON FIBERS

CROSS-REFERENCE TO RELATED APPLICATION

This application is a continuation-in-part of our copending application Ser. No. 105,130, filed Dec. 19, 1979, now U.S. Pat. No. 4,314,981.

SUMMARY OF THE INVENTION

In an aspect of the invention, there is provided a process for preparing carbon fibers form a pitch comprising:

loading the pitch fibers on a net-belt conveyer;

introducing the thus loaded fibers into an infusibilizing furnace having at least two exposing chambers arranged in series, each of the exposing chambers having an atmosphere maintained at a different maximum temperature, thereby raising the temperature of the infusibilizing furnace in a longitudinal direction from the inlet to the outlet of the furnace by steps;

exposing the introduced fibers to a gaseous mixture of air and a gaseous oxidizing agent:

$$U_G \geqq 0.023\left[\frac{(\rho_B \times H) + 10.6}{\theta^{0.7}}\right]$$

wherein $U_G$: the velocity of the oxidizing gaseous mixture in circulation in the infusibilizing furnace (Nm/sec), H: the packing height of the pitch fiber on the net-belt conveyer (m), $\rho_B$: the packing density of the loaded pitch fiber (kg/m$^3$), and $\theta$: the time period of infusibilization (hour), with the following restrictions:

$0.1 \leqq U_G \leqq 1.5$ $0.6 \leqq \rho_B \times H \leqq 150$, $30 \leqq \rho_B \leqq 300$, $0.02 \leqq H \leqq 0.5$, and $1.0 \leqq \theta \leqq 4.0$, and at a temperature lower than the softening point of the pitch fibers by 5° to 50° C., thereby infusibilizing the pitch fibers, introducing the infusibilized pitch fibers into the carbonizing furnace, and carbonizing the thus introduced pitch fibers therein by a flow of an inert gas heated to a temperature of 400° to 1,500° C.

BACKGROUND OF THE INVENTION

The present invention relates to a method for preparing carbon fibers from a pitch by melt-spinning the pitch, infusibilizing the pitch fibers with a mixture of air and a gaseous oxidizing agent under a circulating gas of a velocity in a specified range and carbonizing the thus treated pitch fibers into the carbon fibers.

In the preparation of the carbon fibers, the pitch fibers are subjected to a treatment of infusibilization of the pitch fibers before the carbonization thereof. The pitch fibers are made infusible when the pitch fibers are subjected to a take-up system in which the pitch fibers are fed and taken up around a roll, or a net-belt conveyer system in which the pitch fibers are loaded on and transferred by a net-belt conveyer. However, in the take-up system, a high productivity cannot be obtained since the pitch fibers cannot be taken up at a high velocity due to the low physical strength and ductility thereof. Moreover, it takes much time to mend the pitch fibers when it is broken during the operation.

In the well-known net-belt conveyer system, the pitch fibers are formed into waves by the net-belt and the fibers are locally deformed by the meshes of the net, because the pitch fibers are not sufficiently infusibilized in the steps in the infusibilizing furnace.

The inventor had found that these problems are solved by providing a bar on the upper part of a tray having a u-type cross section and introducing the tray having the pitch fibers suspended on a bar into the furnace of infusibilization and of carbonization thereby effectively carrying out the infusibilization and carbonization (refer to U.S. Pat. No. 4,265,869).

However, in the tray system, the height of suspension of the fiber is restricted by the strength of the fiber, and the packing density of the fiber cannot be made so much large because of the necessity of preventing the accumulation of heat generated by the infusibilizing reaction and the necessity of uniforming the gas flow for the sufficient replacement of the generated gas in the carbonization. The ordinary value of packing density is 1 to 20 kg/m$^3$. Such an amount of the packing density of the fiber is too small from the economical view. That is, in order to make the capacity of the total facilities, it was necessary to have larger furnaces of infusibilization and of carbonization. This was not desirable from the consideration of raising the production efficiency.

DETAILED DESCRIPTION OF THE INVENTION

Figure 1:
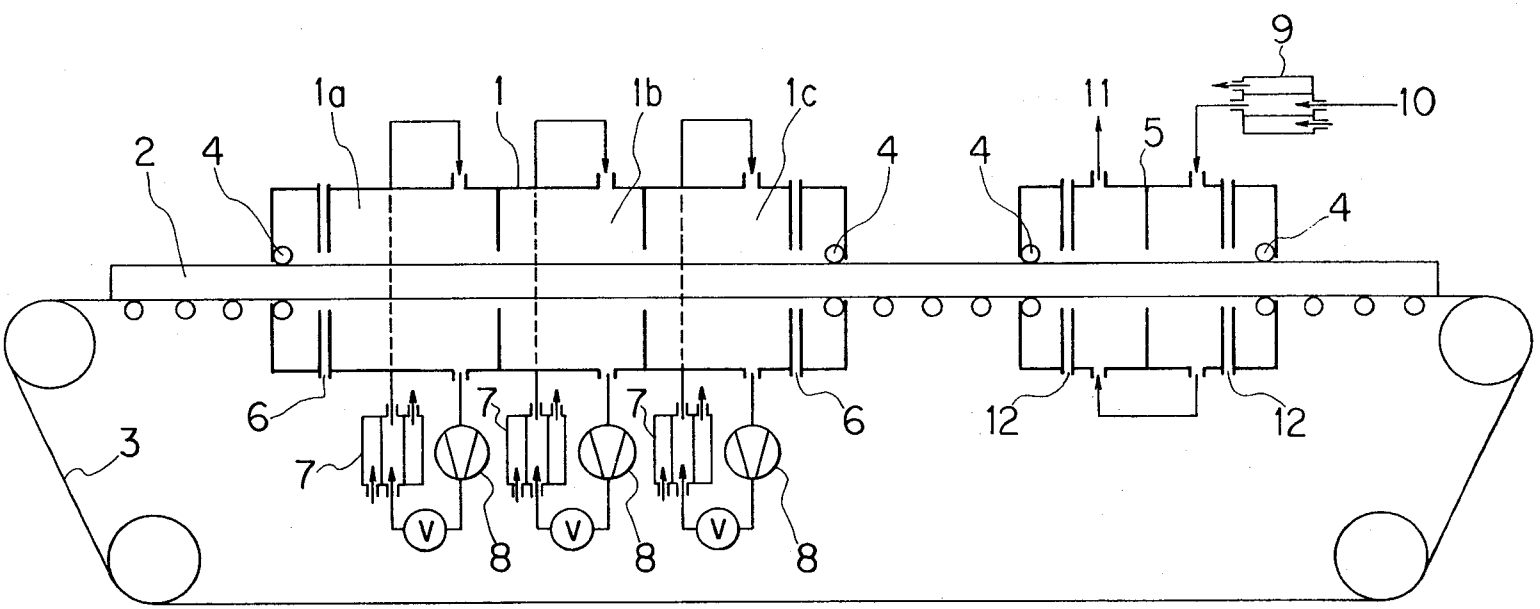
FIG. 1 shows an apparatus suitable for executing the method of the present invention.

According to the present invention, the pitch fibers obtained by melt-spinning of the pitch prepared from petroleum-tar or coal-tar are loaded on a net-belt conveyor at a high packing density and are introduced into an infusibilizing furnace, for instance, as is shown in FIG. 1 by the movement of the net-belt conveyor to be infusibilized in the furnace, and the thus infusibilized fibers are then introduced into a carbonizing furnace also by the movement of the net-belt conveyor to be carbonised in the carbonizing furnace. Since the diameter of the pitch fiber is so small as less than 40 micrometers, it is preferable to combine tens of thousands of the fibers to a tow of 10 to 30 mm in diameter in advance of the treatments for infusibilization and for carbonizing in order to raise the production efficiency.

The characteristic point of the present invention is based upon the present inventor's discovery of the specified conditions of the infusibilizing furnace in operation, that is, the velocity of the oxidizing gaseous mixture in circulation is in the range shown in the following equation (1):

$$U_G \geqq 0.023\left[\frac{(\rho_B X H) + 10.6}{\theta^{0.7}}\right] \quad (1)$$

wherein $U_G$ represents the velocity of the oxidizing gaseous mixture in circulation in the infusibilizing furnace (Nm/sec), $\rho_B$ represents the packing density of the pitch fiber ($kg/m^3$), H represents the packing height of the loaded pitch fiber on the net-belt conveyor (m) and $\theta$ represents the time of infusibilizing operation (hour).

As is seen in Equation (1), the velocity of the gaseous mixture in circulation in the furnace is in proportion to the packing density and the packing height of the loaded pitch fibers on the net-belt conveyer and is inversely proportional to the time of infusibilizing operation. The constants in Equation (1) have been obtained as a result of many experiments, limiting of the present invention.

Figure 2:
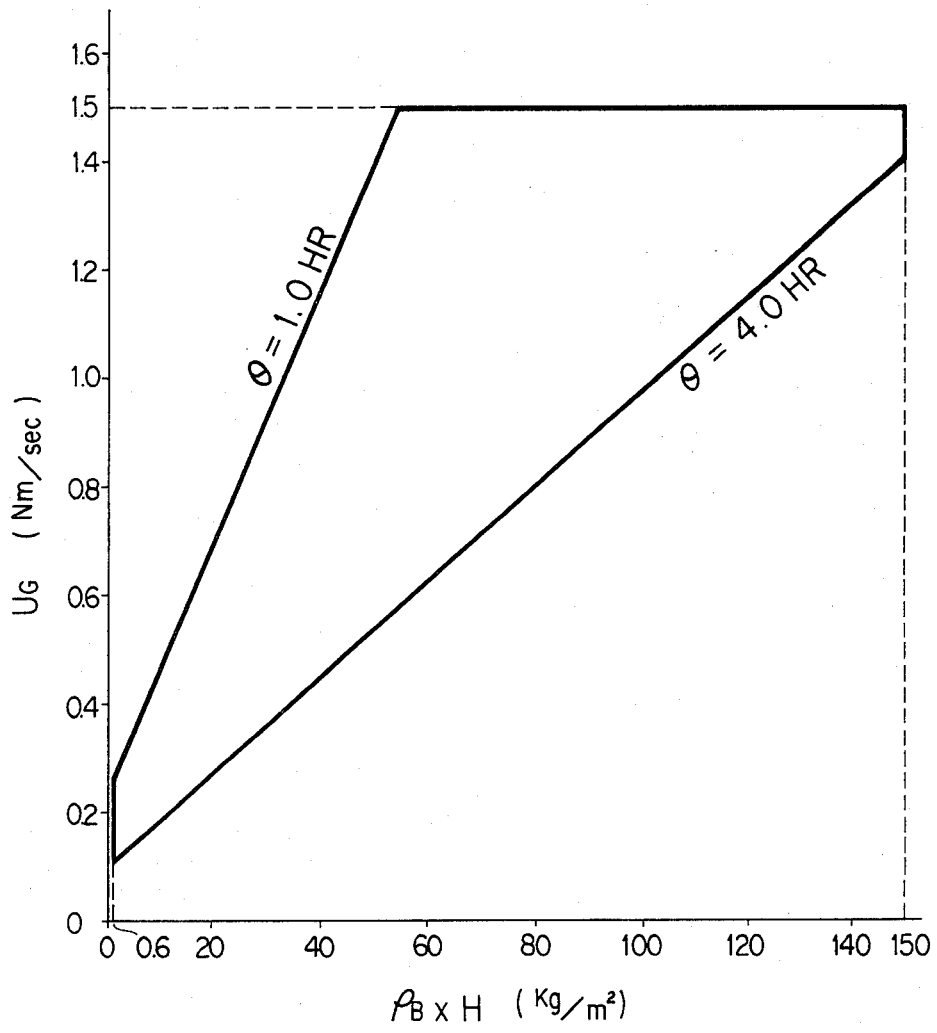
FIG. 2 shows the relationship between the velocity of the gas in circulation and the amount of loaded pitch fibers on the net-belt conveyor, that is, the product of the packing density of the pitch fibers and the packing height of the pitch fibers in the infusibilizing furnace of the present invention.

Equation (1) will be understood further by FIG. 2 which shows the relationship between the amount of loaded substance, the pitch fibers, and the velocity of the gaseous mixture in circulation in the furnace. FIG. 2 shows the relationship between the amount of loaded pitch fibers on the net-belt conveyor ($kg/m^2$), that is, the product of the packing density of the pitch fibers, $\rho_B$ ($kg/m^3$), and the packing height, H(m) taken in the abscissa and the velocity of the gaseous mixture (Nm/sec) taken in the ordinate corresponding to two cases where the time of infusibilizing operation is 1.0 and 4.0 hours, respectively. As is seen in FIG. 2, at a predetermined time of infusibilizing operation, the velocity of the gaseous mixture in circulation should be increased in proportion to the increase of the amount of loaded substance per unit area.

The most suitable range of the velocity of gaseous mixture in circulation in the furnace is shown in the following relationship: $0.1 \leqq U_G \leqq 1.5$, and in the case where $U_G$ is not in the range, it has been confirmed that poor products are obtained.

In the case where the velocity of the circulating gas is too large, the pitch fibers are pressed by the gas flow, resulting in the increase of packing density of the fiber in excess. However, generally, the velocity of circulating gas (Nm/sec) is raised in proportion to the packing density ($kg/m^3$) of the pitch fibers. In the case where the velocity of the circulating gas in the pitch fibers is smaller as compared to the packing density, as a result of uneven distribution of the gas for heat removal, an uneven temperature distribution occurs in the pitch fibers, which causes not only the unevenness of the physical properties of the carbonized fiber but also some reaction in the fibers.

The packing density of the pitch fibers on the net-belt conveyor is variable to an optional extent freely by piling up the tows with a pressure. However, an excessive packing density causes an insufficient removal of the heat generated in the process of infusibilization resulting in the temperature raise within the tow, which possibly makes the pitch fibers over-oxidized. On the other hand, too small a packing density makes the production efficiency unfavorable. Accordingly the usual packing density of the pitch fibers in actual use are 30 to 300 $kg/m^3$, preferably 50 to 200 $kg/m^3$.

The packing height of the pitch fibers may be changed suitably, however, generally it should be in the range of 20 to 500 mm. Too large the height makes the packing density of the lower layer of the pitch fibers too large by deed load causing the insufficient removal of the generated heat. On the other hand, too small the height the production efficiency becomes unfavorable.

Accordingly, it will be easily understood that the amount of loading, that is, $\rho_B \times H$, is preferably in the following range:

$0.6 \leqq \rho_B \times H \leqq 150$.

The time of infusibilizing operation in the present invention is particularly preferable in the range of 1 to 4 hours, that is, $1.0 \leqq \theta \leqq 4.0$. In the case where the time is shorter than 1.0 hour, the degree of infusibilization of the treated fiber is such that the properties of the carbon fibers obtained by the following step (carbonization step) is not so much preferable. On the other hand, in the case where the time is longer than 4.0 hours, the merit due to the improvement of the properties of the carbon fiber obtained from the thus treated fiber for a longer time does not compensate the demerit due to the energy loss and the reduction of producibility caused by the longer retention in the infusibilizing furnace.

The gaseous mixture of air and a gaseous oxidizing agent used in the present invention is a gaseous mixture of air and a gaseous oxidant such as oxygen, ozone, sulfur dioxide, nitrogen dioxide, etc. The amount of the gaseous oxidant is generally 0.1 to 10% by volume of the gaseous mixture. The use of nitrogen dioxide is particularly preferable in the present invention.

The present invention will be explained more in detail while referring to FIG. 1 as follows In the practice of the present invention, the pitch fibers 2 are loaded mat-like on the net-belt conveyor 3 and they are introduced into three chambers, 1*a*, 1*b* and 1*c*, in the order, provided in the infusibilizing furnace 1 via the nipping-roller 4. The nipping-roller acts to isolate the furnace from the outside.

The net-belt conveyer used in the present invention is made of a metallic material, for instance, titanium or stainless steel, and has a net-like construction or has numerous pores in order to pass a gas freely through the net.

Additionally, at the inlet part of the infusibilizing furnace, gas-inducing inlet 6 for use in an air curtain is provided, from which a small amount of air is introduced to make isolation from the atmosphere of outside for preventing the change of the gaseous composition of the atmospheric gas and the reduction of the temperature within the infusibilizing furnace.

Moreover, the temperature raise in the furnace occurring accompanying with the proceeding of infusibilization due to the heat of infusibilization of the pitch fibers is possibly controlled by making a flow of the atmospheric gas in the furnace by the blower or a fan 8 and by the heat exchanger 7.

The temperature of infusibilization in the neighborhood of the introducing part of the net-belt conveyer is lower than the softening point of the pitch fibers by at least 5° to 50° C., and the temperature is gradually raised as the proceeding of infusibilization. However, the temperature should be not higher than 350° C., preferably not higher than 300° C. In addition the temperature of the gaseous mixture in circulation is preferably controlled in the range of 100° to 400° C.

Adoption of the net-belt conveyer in the present invention results in large advantages of having a smaller aperture and of needlessness of providing two additional chambers for gas replacement in the neighbourhood of the inlet and outlet of the infusibilizing furnace and the carbonization furnace. Although there are several methods for isolating the furnace from the outside, for instance, a method of providing nipping-rollers at the inlet and outlet of the furnace or a method of making a gas-seal at the inlet and outlet parts is adopted. By these methods it is possible to prevent the change of the composition and the temperature of the gas in the atmosphere of the furnace. In the infusibilizing furnace, the construction is so designed that the temperature of the gas in the atmosphere is gradually raised from the inlet toward the outlet. Into the carbonizing furnace, an inert gas such as nitrogen is introduced at a high temperature and the infusibilized tow-shaped bundles of the pitch fibers loaded on the net-belt conveyer from the infusibilizing furnace introduced into the carbonizing furnace are continuously brought into contact with the inert gas at a perpendicular at the high temperature of 400° to 1,500° C. for a residence time of 0.1 to 1.5 hours to be carbonized. A blower or a fan is provided in each chamber of the furnace, divided with an appropriate interval to once pull out the gaseous mixture from the lower part of the chamber and then supply the gaseous mixture to the upper part of the chamber, or inversely to pull out the gas from the upper part and then supply to the lower part, in any event, in order to make the gaseous mixture flow up and down. In any way, there are more than 2 means of gas circulation as shown above. In this means of gas circulation of the present invention, heat exchangers are incorporated in order to remove the heat of infusibilization to maintain constant conditions of the gas.

By the above-mentioned up-and-down wise ventilation, the tows comprising the pitch fibers, placed on the net-belt conveyer, are brought into contact with or exposed to a gaseous mixture containing a gaseous oxidizing agent such as $NO_2$ coming vertically from the mesh of the net-belt, therefore, the reaction heat generated not only from the surface of the tow but also that from each pitch fiber are effectively removed. Accordingly, in the method of the present invention, the removal of the heat of infusibilization is carried out efficiently in spite of the high packing density of the pitch fibers. That is, an infusibilization at a very high packing density of the pitch fibers has come to be possible, such a high packing density having never been considered in the conventional tray system of infusibilization in which the heat removal is carried out by the diffusion of the gaseous mixture containing $NO_2$ from the surface of the tow to its internal parts, the gaseous mixture being brought into parallel contact to the suspended tows. The direction of the circulating gas may be upward or downward, however, since in the case of the upward flowing the pitch fibers loaded on the net-belt conveyer are apt to be brought upwards with the gas flow and get twisted necessitating another belt for pressing down the mat-like blowing up, it is preferable to have a downward flow.

In addition, because of the efficient contact of the inert gas at a high temperature into the infusibilized tows, the time period of carbonization has been possibly reduced to highly improve the production efficiency.

The temperature of infusibilization is preferably in the neighbourhood of the softening temperature of the pitch fiber as possible because the time period for infusibilization is shorter, however, in the case of raising the temperature too high to the vicinity of the softening point, partially the temperature of the fiber becomes higher than the pitch possibly making the fiber adhered each other. In opposition, in the case where the difference between the temperature of infusibilization and the softening point is too large, it takes much time for the reaction to be completed necessitating a larger furnace for infusibilization, that is, the temperature of infusibilization is preferably lower than the softening point of the pitch fiber by 5° to 50° C. For instance, in the case of infusibilizing of the pitch fibers of a softening point of about 165° spun from the polymerized pitch produced by treating petroleum pitch, the temperature of the pitch fibers at the inlet part of the infusibilizing furnace is set to 160° to 115° C. Although the softening point of the pitch fiber shifts toward higher side as the infusibilization proceeds, the temperature of the pitch fiber is artificially raised slowly in order to maintain the temperature difference between the softening point and the temperature of the pitch fiber at constant until the softening point becomes about 300°0 C.

It is necessary to provide at least two sets of gas circulating means in the furnace, however, preferably by providing more than 3 sets of gas-circulating means a suitable temperature distribution is obtainable corresponding to the change of physical properties of the pitch fiber as the infusibilization proceeds.

However, it is preferable to adjust the conditions to bring the temperature of the pitch fiber not higher than 350° C., more preferably not higher than 300° C. At a too much higher temperature, the infusibilization proceeds too far resulting in the deterioration of the finally obtained carbon fiber, particularly its tenacity is reduced and its elongation becomes worse.

The transferring velocity of the net-belt conveyer relates to the size of the infusibilization furnace, and is optionally variable, and usually it is designed to have the residence time of 1 to 4 hours in the furnace. The velocity usually used is 0.5 to 50 m/hr.

The pitch fibers on the net-belt conveyer, after finishing infusibilization, carried out from the outlet of the furnace via the nipping-roller 4, the outlet of the furnace being isolated from the atmosphere outside of the furnace by air sealing as in the inlet of the furnace.

The pitch fibers on the net-belt conveyer carried out from the above-mentioned infusibilizing furnace are introduced into the internal part of the carbonizing furnace via the nipping-roller 4 as in the infusibilizing furnace. Nitrogen-seals with an inlet 12 of nitrogen are provided respectively in the inlet and outlet of the carbonizing furnace, and a small amount of an inert gas, for instance, gaseous nitrogen is introduced to isolate the furnace from the atmosphere outside the furnace.

An inert gas, for instance, gaseous nitrogen heated to a temperature of higher than 400° C. by a heat exchanger 9 is introduced into the carbonizing furnace from the inlet 10. After being brought into contact at a right angle with the surface of the mat of the infusibilized pitch fibers, the gas passes through the part of the furnace under the belt conveyer and then goes out from the outlet 11 containing an evaporative component, for instance water and then, if necessary, its heat being recovered. By the above-mentioned procedures, the infusibilized pitch fibers which entered into the carbonizing furnace are heated and carbonized at a temperature of 400° to 1,500° C., preferably at a temperature of 500° to 1,000° C. If necessary, heat may be supplied from outside of the furnace.

The infusibilized pitch fibers on the belt conveyer are directly heated by the inert gas at a high temperature from underside or from upper side and effectively carbonized and after usually 0.1 to 1.5 hours of carbonization carried out from the outlet of the furnace via the nipping-roller.

The higher the temperature of carbonization, the shorter the time for carbonization, however, too much high a temperature is not preferable, because it restricts the material of construction of the conveyer belt, and a large amount of volatile materials generates at a time by the rapid heating of the fiber resulting in the porous fiber with a reduced tenacity and elongation.

The net-belt conveyer may be used in common with the infusibilizing furnace and the carbonizing furnace or each independent net-belt conveyer may be used in each furnace. In the case of using separated conveyer belts, a step of tranship is necessary, however, velocities of two conveyers may be different and there is an advantage of using conveyer belts different in their materials.

By carrying out infusibilization of the pitch fibers utilizing a net-belt conveyer and using the infusibilizing furnace divided into at least two chambers and further by carrying out the carbonization of the thus infusibilized pitch fibers as in the present invention, the infusibilization and the carbonization of a highly packed pitch fibers become possible with an improved production efficiency, as has been described in the present invention.

Moreover, coupled with the needlessness of the additional chambers for replacement in entrance and exit, the remarkable scale down of the infusibilizing furnace and the carbonizing furnace has come to be possible accompanied by reducing the heat loss in the carbonizing furnace and the consumption of the inert gas. Furthermore, the quality of the thus obtained carbon fiber represented by its tenacity and elongation is not different from the carbon fiber produced by the tray system.

The followings are the more concrete explanation of the present invention while referring to the non-limiting examples.

EXAMPLE 1

After melt-spinning pitch fibers from a pitch of a softening point of 165° C. obtained by heat-treating a bottom oil of naphtha cracking for ethylene production, the thus obtained pitch fibers were loaded on a net-belt conveyer having a stainless steel wire net of 5 mesh and a width of 0.5 m and introduced into the infusibilizing furnace of about 6 m in length shown in the attached figure at the transferring velocity of the belt conveyer of 3 m/hour and the pitch fibers were infusibilized therein at a packing density of 100 kg/cm$^3$ with a packed layer of 200 mm in height under the following conditions of:

(1) a gaseous mixture of air and $NO_2$, containing $NO_2$ 1.0% by volume, (2) the maximum temperature of chamber 1a: 150° C. the maximum temperature of chamber 1b: 200° C. the maximum temperature of chamber 1c: 250° C.

(3) the temperature difference between the softening point and the temperature of the pitch fiber in treatment: 15° to 30° C., (4) the time period of infusibilization: 1.8 hours, (5) the velocity of the circulating gas in each chamber: average 0.5 Nm/sec.

In this connection, the conditions of treatment in Example 1, namely, the packing density $\rho_B=100$ kg/m$^3$, the packing height H=0.2 m and the time of infusibilizing operation $\theta=1.8$ hour when substituted into Equation (1) give the velocity of the gaseous mixture in circulation in the furnace $U_G$ of 0.47 Nm/sec.

The fairly favorable coincidence of this calculated value with the actual value of 0.5 Nm/sec in average in (5) tells the validity of Equation (1) found by the present inventor.

In the next step, the thus infusibilized pitch fibers were introduced into the carbonizing furnace of about 2 m in length at the same transferring velocity as in the infusibilizing furnace. By using gaseous nitrogen as an inert gas heated to a temperature of 1,000° C. by an external heat exchanger at a volume of 2 Nm$^3$/kg of the product, carbon fiber, the internal temperature of the furnace could be heated to a predetermined temperature of carbonization of 800° C., and carbon fibers of good quality were obtained after carbonization for 40 minutes. The properties of the thus obtained carbonized fiber are shown in the Table, they being not inferior to those of the carbon fiber prepared by the conventional tray system wherein the consumption of gaseous nitrogen was 7 to 8 Nm$^3$/kg of the product.

TABLE

| Carbon fiber (method) | Properties of Carbon Fiber Prepared by Several Methods: Packing density (kg/m$^3$) | Aspect of infusibilization | Diameter (micron) | Tenacity (g) | Tensile strength (kg/mm$^2$) | Elongation (%) |
|---|---|---|---|---|---|---|
| The present invention | 100 | good | 13–16 | 12.6 | 75.3 | 2.90 |
| Conventional net-belt system | 100 | no good | 10–20 | 4 | <30 | <1 |
| Tray system | 4–10 | good | 13–16 | 12.5 | 76.2 | 2.91 |

EXAMPLE 2

While using the same apparatus in Example 1, the melt-spun pitch fibers prepared in Example 1 as an intermediate were treated under the same conditions as in Example 1 except for the following conditions to be infusibilized:

Transferring velocity of belt-conveyer of 1.5 m/hour,
Packing density of the pitch fibers $\rho_B$ of 300 kg/m$^3$,
Packing height of the pitch fibers H of 0.3 m,
Time of infusibilizing operation $\theta$ of 4 hours, and
Velocity of gaseous mixture in circulation $U_G$ of 1.0 Nm/sec.

The thus obtained infusibilized pitch fibers were excellent in appearance and in properties. The calculated velocity of the gaseous mixture in circulation by substituting the above-mentioned conditions, $\rho_B$, H and in Equation (1) was 0.88 Nm/sec, the results showing that the actual velocity of 1.0 Nm/sec was appropriate.

COMPARATIVE EXAMPLES 1 AND 2

While using the same apparatus in Example 1, the melt-spun pitch fibers prepared in Example 1 as an intermediate were treated under the same conditions as in Example 1 except for the following conditions (1) and (2), respectively, as follows to be infusibilized in Comparative examples 1 and 2:

Comparative Example 1 (Conditions 1)

Velocity of gaseous mixture $U_G$ of 1.0 Nm/sec and

Time of infusibilizing operation $\theta$ of 0.7 hour.

Comparative Example 2 (Conditions 2)

Velocity of gaseous mixture $U_G$ of 0.15 Nm/sec and

Time of infusibilizing operation $\theta$ of 6.0 hour.

In this connection, the time of infusibilizing operation was adjusted by changing the velocity of transferring belt-conveyor.

In these comparative Examples 1 and 2, it was shown that the average strength of the carbonized fibers were 65 kg/mm$^2$ and 63 kg/mm$^2$, respectively, showing the deteriorated mechanical properties as compared to the fibers in Example 1.

What is claimed is:

1. A method for preparing carbon fibers from a pitch, wherein the pitch is spun into pitch fibers, the pitch fibers are treated with an oxidizing gas and the treated fibers are carbonized into the carbon fibers, said method comprising:

introducing the loaded pitch fibers on a net-belt conveyor into a infusibilizing furnace having at least two exposing chambers arranged in series of increasing temperature said exposing chambers having a temperature gradient of 5° to 100° C. per chamber in the direction of from the inlet to the outlet of said infusibilizing furnace;

exposing the introduced pitch fibers to a gaseous mixture of air and a gaseous oxidizing agent by passing said gaseous mixture between said introduced fibers at a temperature lower than the softening point of said pitch fibers by 5° to 50° C., said gaseous mixture is circulated at a velocity represented by the equation (1):

$$U_G \geqq 0.023 \left[ \frac{(\rho_B X H) + 10.6}{\theta^{0.7}} \right] \quad (1)$$

wherein $U_G$ represents said velocity of said gaseous mixture in circulation in said infusibilizing furnace and is in a range of not less than 0.1 and not larger than 1.5 Nm/sec, $\rho_B$ represents the packing density of said pitch fibers loaded on said net-belt conveyer and is in a range of not less than 30 and not larger than 300 kg/m$^3$, H represents the packing height of said pitch fibers loaded on said net-belt conveyer and is in a range of not less than 0.02 and not larger than 0.5 m and $\theta$ represents the time period of infusibilization in said infusibilizing furnace and is in a range of not less than 1 and not larger than 4 hours, within said infusibilizing furnace forcibly.

2. A method according to claim 1, wherein the highest temperature at which said infusibilization is 300° C. and not higher than 300° C.

3. A method according to claim 1, wherein said gaseous oxidant is selected from the group consisting of oxygen, ozone, sulfur dioxide and nitrogen dioxide.

4. A method according to claim 1 or claim 3, wherein said gaseous oxidant is nitrogen dioxide.

5. A method according to claim 1, wherein the amount of nitrogen dioxide is 0.1 to 10% by volume to the amount of air.

* * * * *